United States Patent [19]

Reader

[11] 4,014,523

[45] Mar. 29, 1977

[54] ARENA AISLE RAILING

[76] Inventor: Arthur J. Reader, 293 Pepperidge Road, Hewlett Harbor, N.Y. 11557

[22] Filed: Dec. 12, 1975

[21] Appl. No.: 640,313

Related U.S. Application Data

[63] Continuation-in-part of Ser. No. 577,378, March 14, 1975, abandoned.

[52] U.S. Cl. ..... 256/59

[51] Int. Cl.[2] ..... E04H 17/14

[58] Field of Search ..... 297/183, 410; 248/161; 224/29; 256/1, 59, 65

[56] References Cited

UNITED STATES PATENTS 2,450,093 12/1946 Richardson ..... 297/183

*Primary Examiner*—Werner H. Schroeder
*Assistant Examiner*—Doris L. Troutman
*Attorney, Agent, or Firm*—Allison C. Collard

[57] ABSTRACT

An arena aisle railing comprising a bracket including an extension and having thereon a clamp for attaching the bracket to a frame of an arena seat, and a U-shaped longitudinal bar having a base with a loop portion providing a grip at a top thereof, and a pair of leg portions which are longitudinally adjustably mounted in the bracket.

6 Claims, 4 Drawing Figures

ARENA AISLE RAILING

This is a continuation-in-part of application Ser. No. 577,378, filed Mar. 14, 1975, now abandoned.

The present invention relates to handrails in general, and to an aisle railing attached to seats in particular.

Handrails are useful for safety purposes when walking down or up steps or inclined areas, such as, for example, in arenas, stadiums, coliseums, theatres and the like. To be satisfactory, handrails should provide the capability for a person to readily grip the rail to facilitate movement of the person while minimizing the chance of accident, and at the same time, to provide an unobstructed view. Also, the railing should have a minimum number of parts and should be simple to install. Accordingly, it is an object of the present invention to provide an arena aisle railing achieving the above-mentioned objectives.

It is another object of the present invention to provide an arena aisle railing which is readily mounted on aisle seats and offers an unobstructed view.

It is still another object of the present invention to provide an arena aisle railing comprising a longitudinally adjustable U-shaped bar having a pair of leg portions disposed in a bracket, and having a base portion forming a gripping loop at its top, the bracket being securable to the frame of the seat.

Yet another object of the present invention is to provide a handrail which is uniformly and smoothly continuous without any portions which would catch a part of a person or the clothing thereof, while at the same time providing for increased strength by providing a closed substantially U-shaped member having a smoothly continuous handle portions.

Other objects and features of the present invention will become apparent from the following detailed description when taken in connection with the accompanying drawing which discloses one embodiment of the invention. It is to be understood, hwever, that this drawing is designed for the purpose of illustration and is not intended as a definition of the limits and scope of the invention disclosed.

In the drawing, wherein similar reference numerals denote similar elements throughout the several views.

Figures 1, 2, 3, 4:
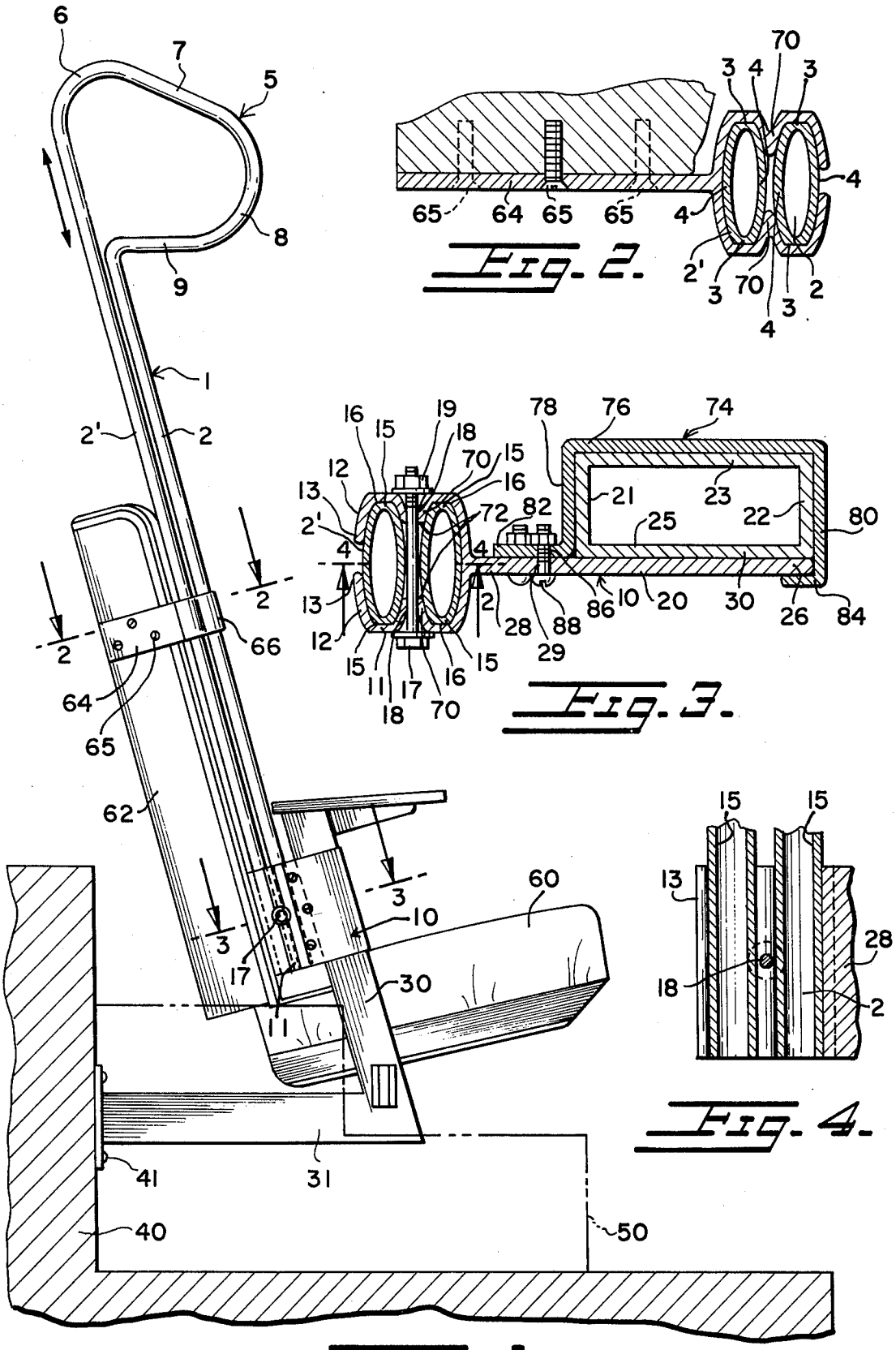
FIG. 1 is an elevation view of the aisle railing of the present invention mounted on an aisle seat.
FIG. 2 is a sectional view taken along the lines 2—2 of FIG. 1.
FIG. 3 is a sectional view taken along the lines 3—3 of FIG. 1.
FIG. 4 is a cross sectional view taken through line 4—4 of FIG. 3.

Referring now to the drawing, FIGS. 1–3 show one unit of an aisle railing 1 having a U-shaped configuration in accordance with the present invention, which comprises a pair of leg portions 2, 2′ each in the form of an elongated bar preferably oval-shaped in cross section as illustrated in FIG. 2, thus preventing relative rotation in the bracket 10, the legs or bar 2, 2′ each defining two flattened parallel sides 3 and arcuate sides, such as semicircular or semi-oval side ends 4. The legs or bar 2, 2′ are shown as being formed hollow, but it also may be formed solid and of other cross-sectional shapes. The top of the bars 2, 2′ is formed with a uniformly continuous closed loop 5 connected with both the leg portions 2, 2′ and is continuous therewith and having an uppermost curved section 6 directly connected with leg portion 2; a straight downwardly inclined section 7, a lower curved portion 8 and a horizontal portion 9, the latter closing the loop 5 and being directly connected with leg portion 2, directed towards and against the longitudinal bar 2. The aisle railing 1 being formed of a continuous one-piece construction of a U-shaped configuration provides for a strengthened construction because of the rigidity and firmness imparted to the loop 5 by the pair of connected leg portions 2, 2′. The loop 5 forms a grip for people walking adjacent the railing, since this particularly formed section is extremely suitable for a person who is walking in the aisle in a downward direction to grab the uppermost portion 6 or the inclined portion 7, whereas a person walking in the aisle in an upward direction will grab the lower portions 8 or 9, the horizontal portion 9 at the bottom being preferable for a child. As illustrated, the loop 5 is inclined downwardly with respect to the bar 1, and is disposed facing a seat portion of the seat 60.

The bar 2, 2′ is longitudinally displaceably mounted in the bracket 10 which forms a flange 11 having an opening complementary in shape to the cross section of the bar 2, 2′ the opening being formed by two curved end portions 12, which have free ends 13 spaced apart from each other to provide for movement of the free ends towards each other. The legs 2, 2′ of the bar are juxtaposed to each other and held by said flange 11 against movement when in a locked condition. Preferably, the surface of each of the legs 2, 2′ is flattened forming a flat engaging surface 15, and likewise, the surface 16 of the bracket 10 is flattened for stable engagement of legs 2, 2′ of the bar in the opening in the bracket portion 11. Since the legs of 2′, 2 of the bar 2 are longitudinally displaceable in the bracket 11, the loop grip 5 may be slidably adjusted by moving it up and down to be placed at a suitable height position, as indicated by the double-headed arrow at the top of FIG. 1. The bracket 10 has a configuration to conform to the outer surfaces of the pair of legs 2, 2′, and includes an inwardly extending portion 70 to space the legs 2, 2′ from each other. When the proper position is acheived for the particular arena or the like, then a bolt 17 which is disposed through complementary openings 72 in portion 70 of the bracket 10 and through an elongated slot 18 in the bracket 11 and between the legs 2, 2′ is tightened. The bolt 17 passes through the openings 72 in the curved portions 12, of the bracket 10 and between the legs 2, 2′; and through portions 70, the longitudinally elongated slot 18, the latter being parallel to the longitudinal axes of each leg 2′, 2 of the bar. A nut 19 is disposed on the non-aisle side of the bracket 10 for tightening the cooperatively threaded bolt 17, thereby securing the legs 2, 2′ in position. The elongated slot 18 permits the longitudinal displacement movement of the U-shaped adjustable bar and in particular the leg portions thereof or bar 2, 2′ between the end limits of the extent of the slot.

Further, the bracket 10 includes an extension 20 extending perpendicular to the bracket portion 11, for engagement with a frame 30 constituting a support portion for a seat 60 and arm rest 32 and extends inclined to and integral with the horizontal frame support portion 31, constituting a cantilever support for the seat, which support is bolted to the vertical wall 40 of the arena by bolts and bolt plate 41.

A clamping or locking device 74 is provided to lock the extension 20 of bracket 10 to the frame 30 of the seat 60. The locking device 74 includes a base portion 76 and a pair of leg portions 78, 80 for engagement with the frame 30. Base portion 76 engages and conforms to the configuration of the surface of wall 23 of frame 30 and the leg portions conform to the surface of wall portions 21, 22 of the frame 30, respectively. Leg 78 is provided with a flange extension 82 and leg 80 is provided with a lip portion 84 for engagement with the outer surface of extension 20 at free end 26 thereof. The flange extension 82 and an arm portion 28 of extension 20 are provided with aligned openings 86 and 29 for receiving locking bolts or devices 88. The locking device 74 conforms to the outer surface of frame 30 and as a result of the cooperation between lip 84 gripping the free end 26 of the outer surface extension 20 and the bolting of the flange extension 82 to the arm portion 28 opposite to the free end 26, the U-shaped bracket 1 is locked to the frame 30 of the seat 60. In order to provide for a tight fit, the spacing between the two inwardly facing surfaces of the parallel leg portions 78 and 80 are made substantially equal to the corresponding dimension of the frame. In addition, the spacing between the two inwardly facing surfaces of base portion 76 and lip portion 84 are made substantially equal to corresponding narrow dimension of the frame 30 plus the thickness of the outer surface extension 20, and the length of leg portion 78 is shorter than leg portion 80 so that the flange extension may be suitably locked to the arm portion 28.

The arm rest 32 is illustrated attached to the frame 30. In practice, the unit of the present invention, constituting the longitudinal bar 2, 2' and the bracket 10, is placed over the frame 30, merely by placing extension 20 against the outer surface of portion 25 of frame 30, and then coupling the locking device 74 to the extension 20. For this purpose, extension 20 is held against portion 25, and then the lip portion 84 is placed over the free end 26 and pressed fitted into engagement with the walls of frame 30; then the flange extension 82 is locked by means of two or more locking bolts 88 to arm portion 28 of the extension 20. Accordingly, a locking and clamping effect is achieved, and the clamping bracket 74 cannot be removed without destroying the bolts.

If desired, the flange extension 82 may suitably be welded to the arm portions 28 for a non-releasable connection. The clamping bracket 74 is preferably made of aluminum and is slightly resilient, providing an inward compression force against the walls 21 and 22, thereby securely holding the frame 30 on the bracket 10, and preventing the bracket from being removed or moving on the frame 30.

As an optional feature, an aluminum strap 64 is secured by three screws 65 (or alternately by welding) onto the back rest 62 of the seat, the strap forming a loop portion 66 in which the legs 2', 2 of the bar are slidably disposed for further stability.

Arena steps 50 are illustrated in dashed lines showing the seat mounted on steps in the arena or the like, or in a theatre, with a bar assembly 1 disposed on the aisle side of the seat.

It is to be noted that particularly the cantilever support of the seat cooperates especially well with the bracket attachment and bar of the present invention. The bracket design may change to conform to fit supporting steel as required. Some of the detail herein is designed for a seat used in a particular arena, and many other designs can also be used in accordance with the present invention.

The legs 2, 2' and the loop 5 are preferably made of aluminum, and the cantilever support, preferably steel. The bracket 10 is also preferably made of aluminum, as well as the bracket closure 74, constituting a clamp extrusion for setting the unit on the cantilever support 30.

While only a single embodiment of the present invention has been shown and described, it will be obvious to those skilled in the art that many changes and modifications may be made thereunto without departing from the spirit and scope of the invention.

What is claimed is:

1. An arena aisle railing for connection to the frame of an arena seat comprising:

a bracket including an extension and having thereon means for attaching said bracket to the frame of the arena seat; and a U-shaped longitudinal bar having a pair of leg portions and a base defining a loop for gripping at a top thereof, said bar being longitudinally adjustably mounted in said bracket, the cross section of said longitudinal bar being oval; and said bracket forming a cooperating oval surface in which said longitudinal bar is mounted.

2. The arena aisle railing as recited in claim 1 wherein said longitudinal bar is hollow.

3. The arena aisle railing as recited in claim 1, wherein said leg portions are juxtaposed to each other and held by said oval surface against movement in a locked condition of said bracket.

4. The arena aisle railing as recited in claim 1 wherein said loop comprises an uppermost curved section in one portion of said loop, and a lower curved section at an opposite portion of said loop, and a straight downwardly inclined section pointing toward said seat and connected to and between both said uppermost curved sections and said lowermost curved sections, and a horizontal section connected to said lowermost curved section.

5. The arena aisle railing as recited in claim 4, wherein said uppermost curved section is connected to one of said leg portions, and said lowermost curved section being connected to said other of said leg portions.

6. The arena aisle railing as recited in claim 1, wherein said means of said bracket includes an extension, and including a locking device comprising a base portion and a pair of leg portions, one of said leg portions having a lip extension for engagement with the outer edge of said extension, the other of said leg portions having a flange portion for securement to said extension for locking said locking device to said extension.

* * * * *